US010518300B2

(12) United States Patent
Karjunen

(10) Patent No.: US 10,518,300 B2
(45) Date of Patent: Dec. 31, 2019

(54) METHOD AND MEANS FOR RECOVERY BOILER OUTAGE

(71) Applicant: Varo Teollisuuspalvelut Oy, Helsinki (FI)

(72) Inventor: Timo Karjunen, Helsinki (FI)

(73) Assignee: VARO TEOLLISUUSPALVELUT OY, Helsinki (FI)

( * ) Notice: Subject to any disclaimer, the term of this patent is extended or adjusted under 35 U.S.C. 154(b) by 0 days.

(21) Appl. No.: 15/742,064

(22) PCT Filed: Nov. 5, 2015

(86) PCT No.: PCT/FI2015/050762

§ 371 (c)(1),
(2) Date: Jan. 5, 2018

(87) PCT Pub. No.: WO2017/009519

PCT Pub. Date: Jan. 19, 2017

(65) Prior Publication Data

US 2018/0193888 A1 Jul. 12, 2018

(30) Foreign Application Priority Data

Jul. 16, 2015 (FI) ..... 20155558

(51) Int. Cl.
*B08B 9/093* (2006.01)
*B08B 3/10* (2006.01)
(Continued)

(52) U.S. Cl.
CPC ..... *B08B 9/0933* (2013.01); *B08B 3/10* (2013.01); *B08B 3/102* (2013.01); *D21C 11/12* (2013.01); *F22B 37/52* (2013.01); *F23J 3/02* (2013.01)

(58) Field of Classification Search
CPC ..... B08B 9/0933
See application file for complete search history.

(56) References Cited

U.S. PATENT DOCUMENTS 1,255,944 A 2/1918 Stevens
4,014,526 A 3/1977 Cramer, Jr.
(Continued)

FOREIGN PATENT DOCUMENTS

FI 20065668 A 4/2008
FI 20086166 A 6/2010
(Continued)

OTHER PUBLICATIONS

Office Action issued for Chile Patent Application No. 201800091, dated Oct. 16, 2018, 16 pages including 8 pages of English Translation.
(Continued)

*Primary Examiner* — Mikhail Kornakov
*Assistant Examiner* — Ryan L. Coleman
(74) *Attorney, Agent, or Firm* — Ziegler IP Law Group, LLC

(57) ABSTRACT

A method and means for washing a floor of a recovery boiler, including mixing by mixing devices wash water in which remaining salt on recovery boiler furnace floor dissolves, and where wash water is sucked from a wash water pool on the furnace floor into suction openings of the mixing devices for implementing said mixing.

7 Claims, 5 Drawing Sheets

(51) Int. Cl.

| | |
|---|---|
| ***D21C 11/12*** | (2006.01) |
| ***F22B 37/52*** | (2006.01) |
| ***F23J 3/02*** | (2006.01) |

(56) References Cited

U.S. PATENT DOCUMENTS

| | | | | |
|---|---|---|---|---|
| 4,437,765 | A | 3/1984 | Seeger | |
| 4,808,264 | A | 2/1989 | Kignell | |
| 6,287,415 | B1 | 9/2001 | Salmi et al. | |
| 6,311,630 | B1 | 11/2001 | Vanhatalo | |
| 2004/0226587 | A1* | 11/2004 | Lemire | B08B 9/093 134/99.1 |
| 2007/0137680 | A1* | 6/2007 | Fisher | B08B 9/0933 134/166 R |
| 2008/0047587 | A1 | 2/2008 | Ball | |
| 2008/0079203 | A1 | 4/2008 | Gibowski | |
| 2009/0266277 | A1 | 10/2009 | Karjunen | |
| 2011/0232688 | A1 | 9/2011 | Karjunen | |

FOREIGN PATENT DOCUMENTS

| | | | |
|---|---|---|---|
| JP | S59-47493 | A | 3/1984 |
| JP | H02269009 | A | 11/1990 |
| JP | 2000039133 | A | 2/2000 |
| KR | 20130142867 | A | 12/2013 |
| WO | 2008046959 | A1 | 4/2008 |
| WO | 2010063875 | A1 | 6/2010 |

OTHER PUBLICATIONS

Valmet Smelt-X esite, "Shorten your shutdowns & cut costs, Smelt-X, Smelt extraction" http://www.valmet.com/Valmet/products/Vault2MP.nsf/BYWID-140516-2256E-40D0B/$File/HPGB_H_2300_057-02_SmeltX_presentation.pdf? OpenElement, May 16, 2014, 28 pages.

Finland Patent Office, Search Report, Application No. 20155558, dated Nov. 9, 2015, 2 pages.

International Search Report, Application No. PCT/FI2015/050762, dated Jul. 1, 2016, 4 pages.

Takahashi et al. "Annual Shutdown Cleanliness of the Recovery Boiler Furnace Floor", Aracruz Celulose, Brazil, 2007 International Chemical Recovery Conference, 4 pages.

Written Opinion of the International Search Authority, Application No. PCT/FI2015/050762, dated Jul. 1, 2016, 4 pages.

Extended European Search Report received for European Patent Application No. EP15898187.8, dated Feb. 20, 2019, 6 pages.

European Patent Office, Communication pursuant to Article 94(3) EPC, Application No. 15898187.8, dated Jul. 31, 2019, 4 pages.

* cited by examiner

METHOD AND MEANS FOR RECOVERY BOILER OUTAGE

FIELD

The aspects of the disclosed embodiments are related to (soda) recovery boiler floor washing during outage.

BACKGROUND

Recovery boilers are fueled with waste liquor generated in connection with pulp manufacture containing various sodium salts, mainly sodium carbonate and sodium sulfate, in addition to organics and water. These salts form a salt bed on a furnace floor during boiler operation. The bed is at least partly molten so that molten salt flows continuously from the bed to smelt spouts through smelt spout openings located on a lower part of the furnace, and further to a dissolving tank.

The smelt spout openings are typically placed at a level higher than the furnace floor so that the salt bed on the floor is at least 200-250 mm thick.

Recovery boilers have become gradually larger so that modern recovery boilers have a floor area of 150-300 $m^2$. In addition, modern recovery boilers are typically equipped with a so called decanting floor, with floor tubes sloping downwards from a back ball, where the smelt spout openings typically are, towards the centerline of the floor so that the lowest elevation extends several meters, even over eight meters, from the back wall. The salt bed residing on the floor is hence considerably thicker at the centerline than in the proximity of the back wall.

These factors—the increase in recovery boiler size, the use of decanting floor as a standard design instead of flat floors or floors sloping towards the back wall—have together led to the current situation in which the remaining salt bed during the outage in a modern recovery boiler is large both in thickness and volume; in the largest boilers the salt bed thickness at the floor centerline is 0.5-0.7 m and the total volume of the bed is over 100 $m^3$.

When the furnace floor is inspected, the floor needs first to be made free from salt (smelt) remaining on the floor. Conventionally, the recovery boiler furnace floor is cleaned as follows:

1. During washing of superheaters, hot water is pumped to furnace floor through nozzles installed in primary air port openings. Water also rains or flows to the floor typically from soot blowers used in superheater washing and possibly from wash water sprays used in superheater washing or wall washing. Water on the floor flows out of the furnace as an overflow through smelt spout openings to smelt spouts and further to the dissolving tank. Water in the dissolving tank can be partly recirculated back and further used in furnace floor washing.
2. As soon as the superheater washing is completed, the water pool on the floor is emptied using for example a vacuum truck. And, the salt remaining on the floor is removed mechanically by chopping the salt bed to pieces that are small enough so that they can be piled on top of each other in the middle of the furnace or moved away from the furnace for example to a vacuum truck.

The used method is labor-intensive, time consuming, expensive and risky. The outcome of the washing is often so poor that a large part of the salt remaining on the floor has to be removed mechanically. The floor cleaning after the washing may thus take even several days. The time spent on floor cleaning often extends the whole mill outage and accordingly reduces the mill production, so the costs due to this loss of production can be several millions of euros. Mechanical cleaning with chopping the salt may also damage the floor tubes, in which case additional outage time is needed for repairing the damages.

Due to the risks associated with mechanical cleaning the floor washing is performed in certain mills by using high pressure washers which are installed in smelt spout openings or burner openings. The high pressure washers employ considerably high pressure, 80-100 MPa (800-1000 bar) or even 250-300 MPa. The pressures used are of the same order of magnitude as those used in steel cutting machines, so also the use of high pressure washers can damage the floor or wall tubes.

SUMMARY

According to a first aspect of the disclosed embodiments there is provided a method in recovery boiler outage, comprising:

mixing by mixing devices wash water in which remaining salt on recovery boiler furnace floor dissolves, in which method wash water is sucked from a wash water pool on the furnace floor into suction openings of the mixing devices for implementing said mixing.

The mixing is performed during the furnace floor washing stage, that is, after hot molten salt (smelt) removal stage and before the furnace floor emptying stage in which the floor is emptied from wash water.

In certain example embodiments, the sucked wash water is discharged back into amongst the remaining wash water through discharge openings of the mixing devices for implementing said mixing.

In certain example embodiments, sucked wash water is replaced by guiding fresh wash water onto furnace floor for implementing said mixing.

In certain example embodiments, said mixing is implemented by mixing devices placed on the floor of the recovery boiler.

In certain example embodiments, wash water on the furnace floor is mixed by mixing devices, operated by pressurized air, which are installed on the floor through smelt spout openings.

In certain example embodiments, said mixing is implemented by ejectors with gas or fluid as pressure medium.

In certain example embodiments, wash water is sucked from a wash water pool bottom.

In certain example embodiments, the wash water pool top layer is mixed with the wash water pool bottom layer.

In certain example embodiments, a wash water circulation is formed on the furnace floor by directing the mixing devices in accordance with a desired direction of circulation.

In certain example embodiments, the method comprises removing during recovery boiler outage before washing the floor of the recovery boiler a part of the salt from the furnace in a molten form.

In certain example embodiments, the method comprises guiding wash water into recovery boiler furnace via water passages arranged in the recovery boiler for washing the floor of the recovery boiler. In certain example embodiments, wash water is pumped onto furnace floor with the aid of wash sprays installed in primary air openings on recovery boiler walls. The water pumped into the furnace may be for example feed water, condensate, firewater or water from dissolving tank. Hot (70-80° C.) water will normally be used in order to expedite the dissolving of salt.

In certain example embodiments, a major part of salt remaining on the recovery boiler floor in outage is removed in a molten form and the pumping of wash water onto furnace floor is started as soon as the boiler pressure has been reduced, and the wash water on the floor is mixed with the aid of mixing devices set on the floor.

In certain example embodiments, a major part of salt is removed in a molten form with the aid of suction devices. Smelt may be removed by suction devices from the middle of the floor, whereupon only a thin layer of salt remains on the floor which salt can be removed relatively easily by washing.

In certain example embodiments, the pumping of wash water is started as soon as the boiler pressure has been reduced so that the temperature of the floor tubes has been adequately decreased (that is, the temperature typically is less than 150° C.) or the temperature difference between the wash water and floor tubes is small enough.

According to a second aspect of the disclosed embodiments there is provided an apparatus comprising:

wash water mixing means for implementing a method of the preceding aspect or any of the embodiments of the preceding aspect.

SHORT DESCRIPTION OF THE DRAWINGS

In the following, the disclosed embodiments will be described by way of example with reference to the appended drawings, in which.

DETAILED DESCRIPTION

The figures shown are not entirely to scale, and they primarily serve to illustrate the embodiments of the present disclosure.

Figure 1:
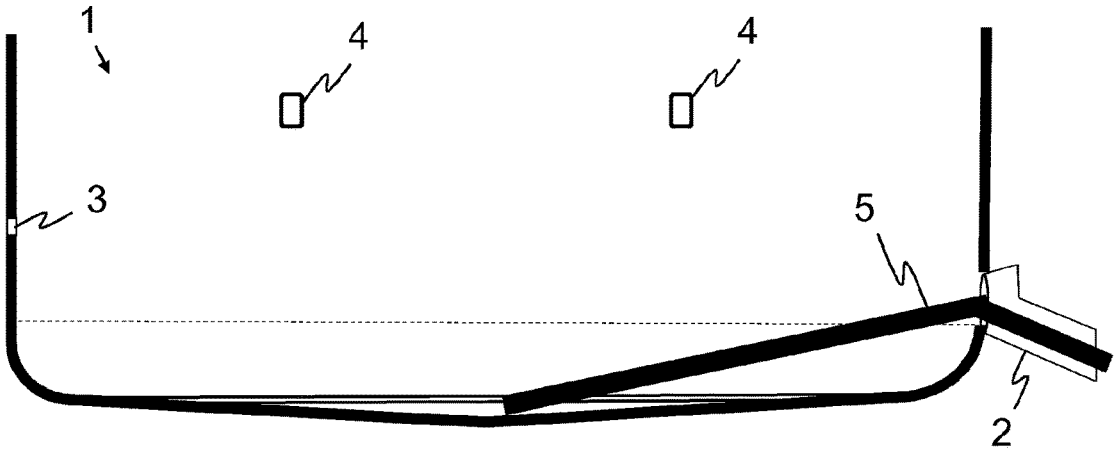
FIG. 1 shows an arrangement for removing smelt during outage.

FIG. 1 shows a cross-section of a lower portion of a recovery boiler furnace during recovery boiler outage. The recovery boiler in FIG. 1 has a floor structure of a decanting type. The presence of a decanting floor, however, is not a prerequisite for the utilization of the invention, as the invention can be applied also in boilers with different floor design. The reference numeral 1 refers to a furnace, reference numeral 2 to smelt spouts in the boiler back wall, reference numeral 3 to primary air port openings in the front wall and reference numeral 4 to start-up burner openings in the side wall. The number of primary air port openings, start-up burner openings and smelt spouts and their location in different walls may vary depending on boiler design. The smelt spouts are typically located either on the back wall or side walls of the boiler.

A smelt pool formed on the floor of the furnace 1 is emptied with a smelt removal device 5 installed in the smelt spout 2. The device 5 is selected so that the pool can be emptied as completely as possible so that only a thin layer of salt remains on the floor. Examples of applicable smelt removal devices has been presented for example in patent applications FI20065668 and FI20086166 (smelt ejectors operated by pressurized gas). Alternatively, another removal device, such as a spiral pump, may be used. In the figure, the dashed line shows the surface level of the smelt pool before the commencement of emptying and the double line shows the surface level of the smelt pool at a late stage during emptying.

Smelt removal is continued as long as the pool has been emptied as completely as possible. After this the devices are removed, the firing of auxiliary fuel and black liquor, if used, is stopped and the cooling of the boiler and pressure reduction is commenced. The pressure reduction and cooling is continued until the floor tube temperature is sufficiently low. The salt remaining on the floor cools down simultaneously so that the floor washing can begin safely.

Figure 2:
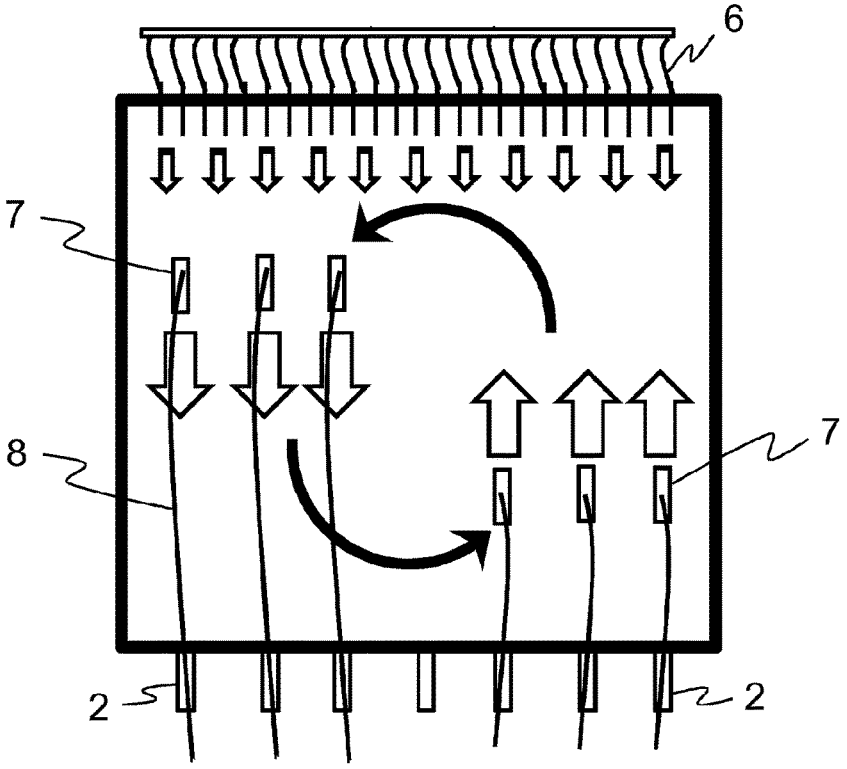
FIG. 2 shows an arrangement for washing the furnace floor of a recovery boiler in accordance with an embodiment of the present disclosure.

FIG. 2 shows an arrangement in accordance with an embodiment of the present disclosure in which wash water of a wash water pool on the furnace floor, in which wash water the remaining salt on recovery boiler furnace floor dissolves, is mixed by mixing devices. Wash water is sucked from the wash water pool into suction openings of the mixing devices for implementing said mixing.

FIG. 2 shows the recovery boiler floor from above. Hot wash water is pumped for example from a feed water or condensate tank (not shown) to wash water nozzles 6 installed in boiler front wall primary air port openings (not shown in FIG. 2). Mixing devices 7 have been installed on the furnace floor through smelt spout openings 2. The mixing devices cause the water volume on the floor to move and to mix thus preventing the vertical stratification of wash water which would disturb the dissolution of salt into wash water. The intention is thus to prevent the saturation of the wash water on the floor with salt, whereupon no more salt from the floor would anymore dissolve into it.

The mixing devices 7 can be placed into the furnace so that the mixing of wash water pool is as efficient as possible or, for example, so that mixing is most efficient in areas with the highest concentration of salt. The figure shows with arrows the wash water flow direction during mixing.

The mixing device 7 can be operated by pressurized air. It can then take the pressurized air needed from the pressurized air system of the mill (not shown). FIG. 2 shows a pressurized air tube 8, which passes through the smelt spout opening 2 to each mixing device 7 set on the floor.

Figure 3:
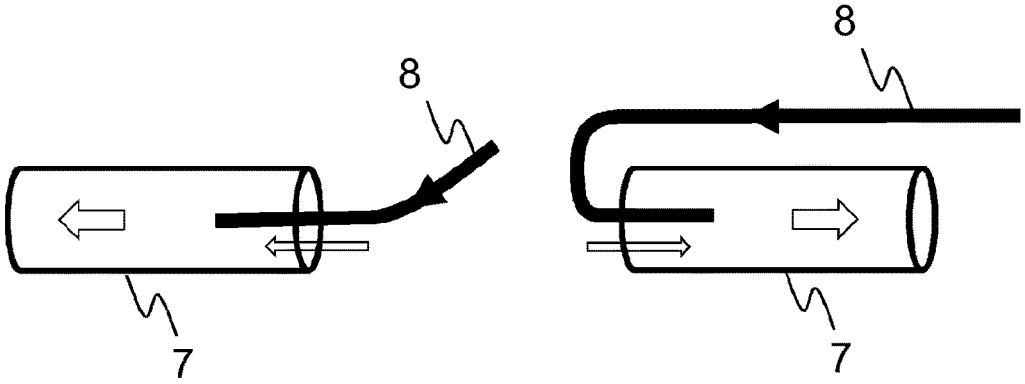
FIG. 3 shows mixing devices in accordance with an embodiment of the present disclosure.

FIG. 3 shows examples of certain simple mixing devices. The mixing devices in FIG. 3 are kind of ejectors (however missing a diffuser typical to ejectors). A pressurized air tube 8 is led into inside of the ejector at an end of a suction pipe of the ejector so that pressurized air is discharged into inside of the pipe into the discharge direction of the device. The discharged pressurized air sucks wash water into a suction opening of the device. The mixture of water and air exits at an opposite end of the suction pipe, the outlet opening. The directions of propagation of water and air are illustrated by arrows. The device can be dimensioned for example so that the mixture of water and air travels within the suction pipe at least 300-400 mm.

For example, both "pulling" and "pushing" mixing devices can be used as mixing devices 7 so that on one side of the furnace floor water is "pushed" away from the back wall and on the other side "pulled" towards the back wall so that water on the floor is circulated as well as possible. The direction is determined by the air tube direction inside the suction pipe. If in FIG. 3 the back wall of the recovery boiler is considered to the right, the mixing device installed through the smelt spout opening on the left side would be "a pushing mixing device" and the one on the right side "a pulling mixing device".

Alternatively, the pressure medium in the mixing device can be other pressurized gas or liquid instead of pressurized air, for example water. In the latter case the mixing device may be kind of a liquid-liquid ejector wherein the pressure of water used as pressure medium can be for example 10 bar. Instead of or in addition to the mixing device(s) shown in FIG. 3 another applicable device can be used as the mixing device, such as an applicable pump or, for example, a propeller installed inside a tube.

Figure 4:
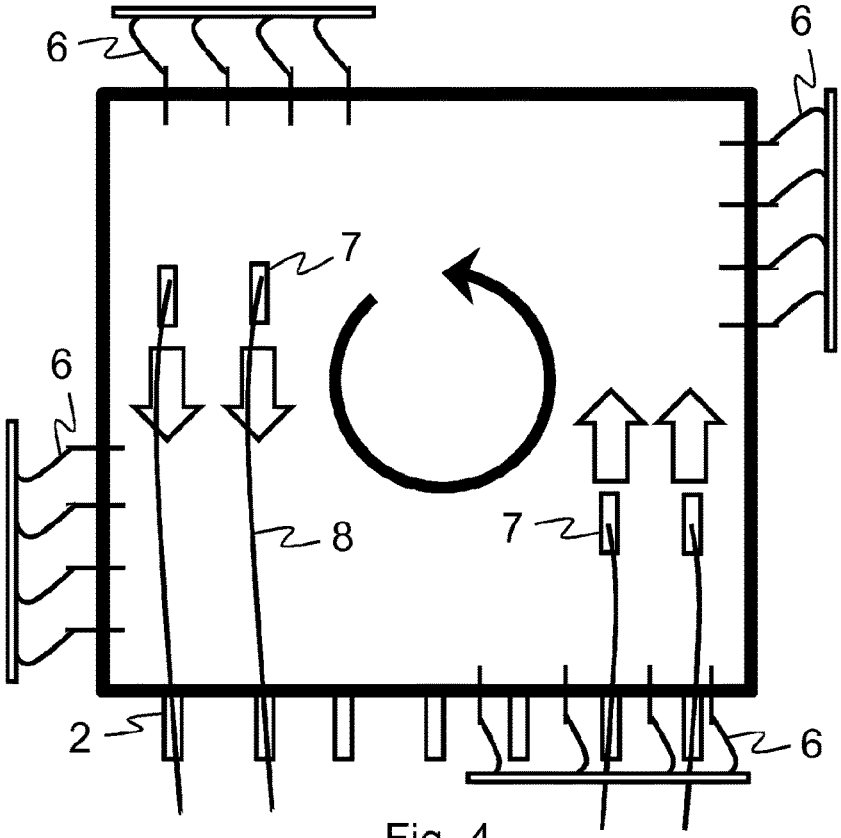
FIG. 4 shows an arrangement for washing the furnace floor of a recovery boiler in accordance with another embodiment of the present disclosure.

FIG. 4 shows an arrangement for washing the furnace floor of a recovery boiler in accordance with another embodiment of the invention. Wash water sprays 6 have been installed in primary air port openings in all recovery boiler walls. The sprays have been installed asymmetrically with respect to the centerline of each wall, on the right side of the centerline in the figure approaching the boiler corners. With this arrangement the top layer of the water on the furnace floor will circulate in a desired direction, in a counter-clock-wise direction in the figure. The mixing devices 7 have additionally been installed on the furnace floor for mixing the wash water volume as described in FIG. 2. The mixing devices 7 set on the furnace floor suck wash water into the suction openings of the mixing devices at least partially below the wash water surface, from the wash water pool bottom in certain preferred embodiments. The mixing devices 7 discharge the sucked wash water back into amongst the remaining wash water through discharge openings of the mixing devices.

Figure 5:
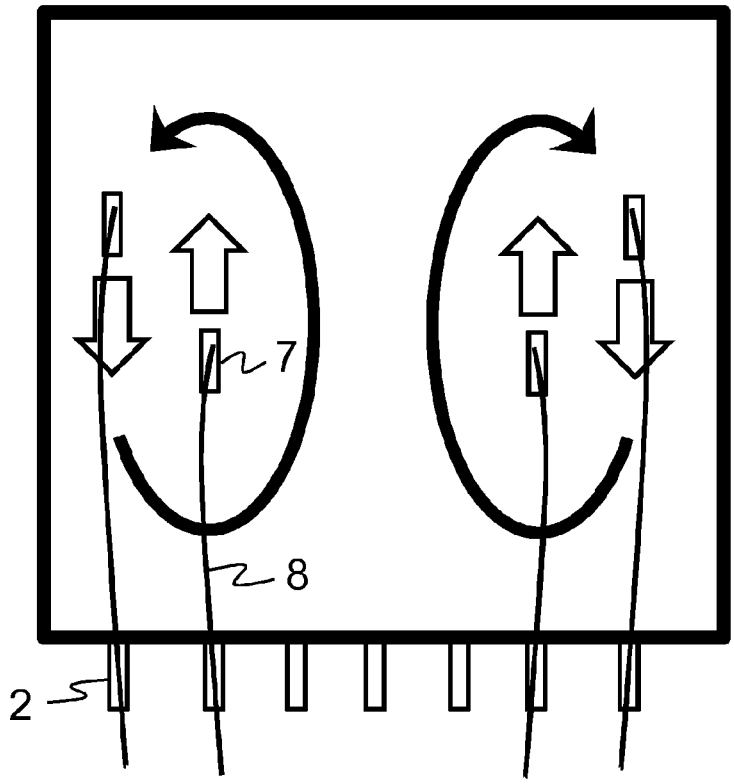
FIG. 5 shows an arrangement in accordance with yet another embodiment of the present disclosure.

FIG. 5 shows an arrangement in accordance with yet another embodiment of the present disclosure. The wash water sprays feed water onto the furnace floor also in this arrangement, although they are not shown in the figure. In this embodiment, again the circulation of wash water is formed on the furnace floor by directing the mixing devices 7 in accordance with the desired direction of circulation, but the circulation pattern deviates from the one previously presented. Instead one circulation vortex, two vortexes are formed on the floor by placing both pushing and pulling mixing devices 7 on both sides of the floor.

Figure 6:
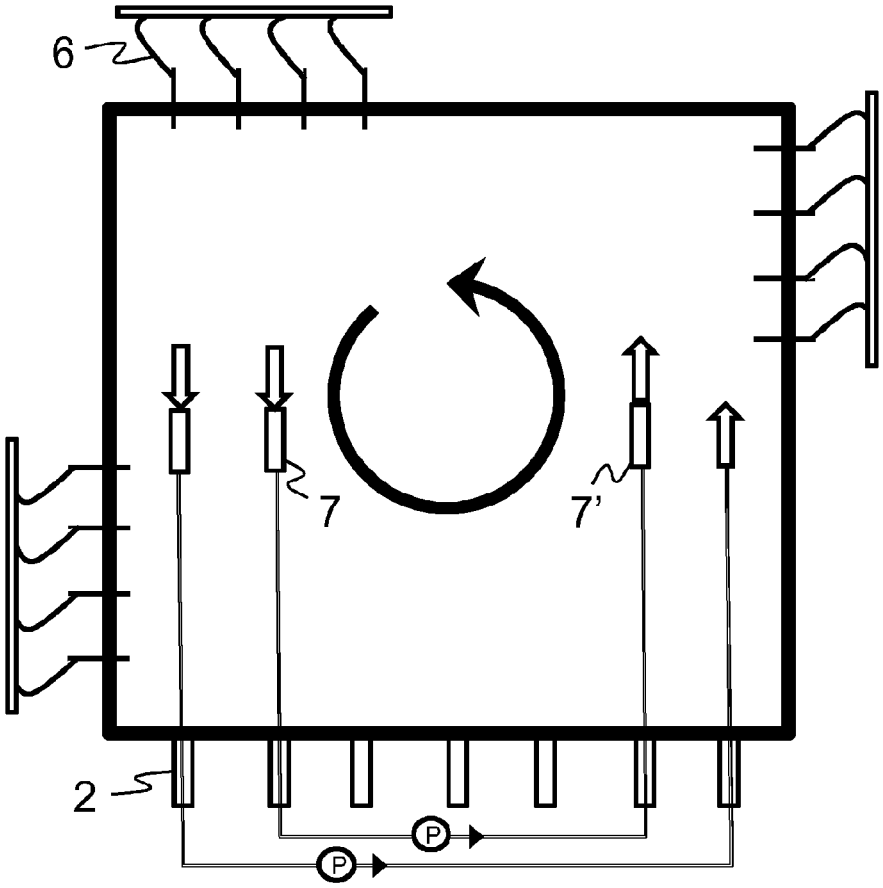
FIG. 6 shows an arrangement in accordance with yet another alternative embodiment of the present disclosure.

FIG. 6 shows an arrangement in accordance with yet another alternative embodiment of the invention. In this embodiment, again the circulation of wash water is formed on the furnace floor, but the mixing devices 7 do not discharge the sucked wash water immediately back into amongst the remaining wash water. Instead, the wash water is conveyed to another location in the furnace and discharged back into amongst the remaining wash water with another mixing device 7' (or by just flowing the water back to the pool by pressure). Wash water can be pumped by pump P from one mixing device to another or directly to the pool. The pumping can be implemented through a piping out of the furnace for example via the smelt spout opening 2 and for example via another smelt spout opening back to the furnace. The pump or pumps P can be placed for example on the dissolving tank deck.

Figure 7:
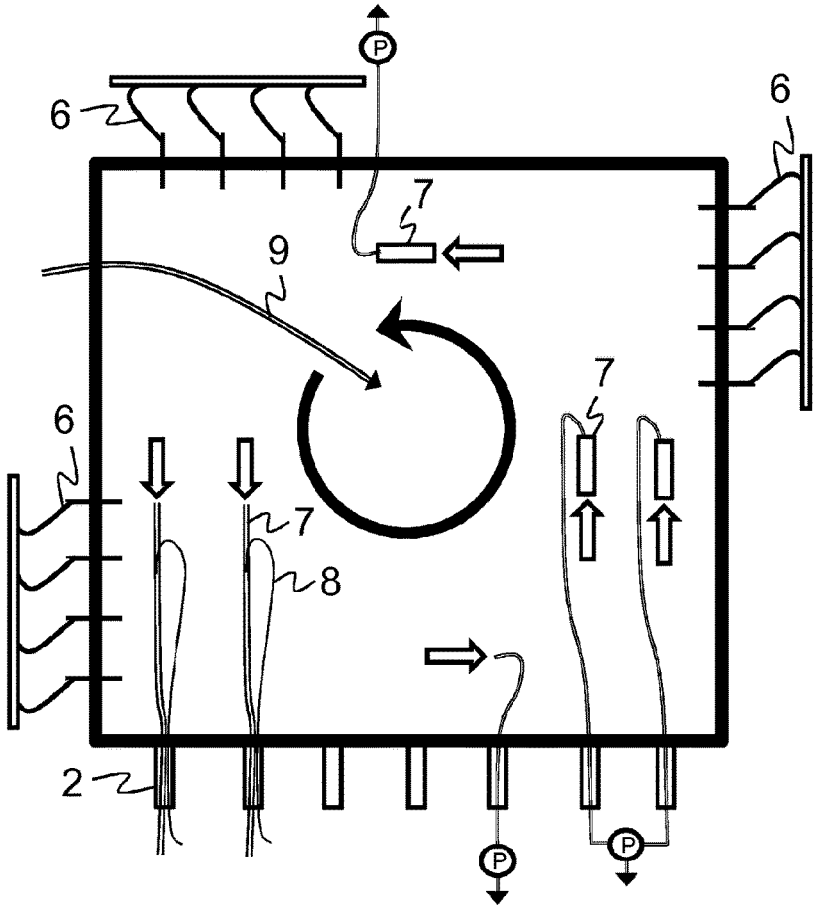
FIG. 7 shows yet certain alternative embodiments.

FIG. 7 shows yet certain alternative embodiments for washing the furnace floor. In the embodiments of FIG. 7, again the circulation of wash water is formed on the furnace floor, but the salty wash water sucked by the mixing devices 7 is not discharged back into the furnace. Instead, the sucked wash water is replaced by conveying hot fresh low-salt wash water (e.g., feed water) onto the furnace floor for example through sprays 6 during the washing of the furnace floor. The mixing devices 7, which in this embodiment can be for example suction tubes installed on the bottom or for example ejectors, suck salty wash water from the wash water pool bottom and out from the furnace. The suction creates the desired mixing and circulation. The pumps (if needed) can be positioned outside of the furnace for example on the dissolving tank deck or similar. Salty water can be sucked from the furnace with pumps P along piping installed on the wash water pool bottom via smelt spout opening 2 or another opening. In this embodiment, as well as in other embodiments, it is additionally possible to spray water for example through burner openings or black liquor in-feed openings (not shown) into areas of smelt pool where there is an exceptionally thick layer of salt. In FIG. 7 this has been illustrated by reference numeral 9.

Figure 8:
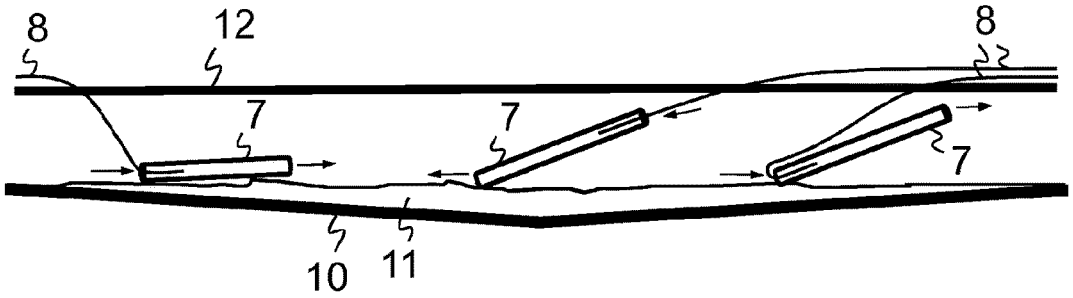
FIG. 8 shows different alternatives for placing mixing devices on furnace floor.

FIG. 8 shows different alternatives for placing mixing devices 7 on the furnace floor in the preceding embodiments. The reference numeral 10 shows the recovery boiler/furnace floor, reference numeral 11 the salt layer accumulated on it and reference numeral 12 the wash water pool surface. Ejectors are here used as examples of mixing devices. A pressurized air tube 8 leads to each ejector as described in the foregoing.

The mixing device 7 on the left sucks wash water from the wash water pool bottom into the suction opening and discharges the sucked wash water through the discharge opening back into amongst the remaining wash water also onto the wash water pool bottom. The mixing device 7 in the middle sucks wash water from the wash water pool surface into the suction opening and discharges the sucked wash water through the discharge opening back into amongst the remaining wash water onto the wash water pool bottom. The mixing device 7 on the right sucks wash water from the wash water pool bottom into the suction opening and discharges the sucked wash water through the discharge opening back into amongst the remaining wash water on the wash water pool surface. The wash water pool top layer is mixed with the bottom layer. The presented alternatives can be used in the embodiments presented in the foregoing. The wash water flow patterns are illustrated using arrows.

The foregoing description provides non-limiting examples of certain embodiments of the invention. It is clear to a person skilled in the art that features which have been described in connection with only one or some of the embodiments can be used also in other embodiments. The presented placement of for example parts of the recovery boiler, wash sprays and mixing devices depend on the implementation. It is clear to a person skilled in the art that the invention is not restricted to details presented above, but that the invention can also be implemented in other equivalent ways. In this document, the terms comprise and include are open-ended expressions with no intended exclusivity.

Some of the features of the presented embodiments may be used to advantage without the corresponding use of other features.

In certain embodiments of the present disclosure, a part of the salt is removed from the furnace in a molten form during recovery boiler outage before washing the floor of the recovery boiler. For example, this is not an indispensable requisite for the use of the method in accordance with the first aspect of the disclosed embodiments, but the method can be used without salt being removed in a molten form before washing. As such, the foregoing description should be considered as merely illustrative of the principles of the present disclosure, and not in limitation thereof. Hence, the scope of the disclosed embodiments are only restricted by the appended patent claims.

The invention claimed is:

1. A method of cleaning a recovery boiler, comprising:

cleaning a recovery boiler during a furnace floor washing stage after a first amount of salt has been removed from the recovery boiler in molten form, said cleaning comprising:

placing mixing devices on a furnace floor of the recovery boiler, wherein a second amount of salt is located on the furnace floor of the recovery boiler, wherein each mixing device comprises a conduit with a suction opening and a discharge opening, and wherein each mixing device comprises a pressurized air tube configured to eject air into the conduit;

mixing salt of the second amount of salt with wash water in a wash water pool on the furnace floor, wherein the mixing is performed by ejecting pressurized air through the pressurized air tubes such that wash water is sucked into the suction openings and discharged out of the discharge openings.

2. A method according to claim 1, wherein sucked wash water is replaced by guiding fresh wash water onto the furnace floor.

3. A method according to claim 1, wherein wash water is sucked from a wash water pool bottom.

4. A method according to claim 1, wherein a wash water pool top layer is mixed with a wash water pool bottom layer.

5. A method according to claim 1, wherein a wash water circulation is formed on the furnace floor by arranging the mixing devices in accordance with a direction of circulation.

6. A method according to claim 1, comprising:

removing the first amount of salt from the recovery boiler in molten form during a recovery boiler outage before washing the floor of the recovery boiler.

7. A method according to claim 1, comprising:

guiding wash water into the recovery boiler furnace via water passages arranged in the recovery boiler for washing the floor of the recovery boiler.

* * * * *